US011749215B2

(12) United States Patent
Lee et al.

(10) Patent No.: US 11,749,215 B2
(45) Date of Patent: Sep. 5, 2023

(54) DISPLAY DRIVING DEVICE AND DRIVING METHOD

(71) Applicant: SILICON WORKS CO., LTD., Daejeon (KR)

(72) Inventors: Do Hoon Lee, Daejeon (KR); Jung Eun Baek, Daejeon (KR); Chan Yung Kim, Daejeon (KR); Hyun Kyu Jeon, Daejeon (KR); Ji Won Lee, Daejeon (KR)

(73) Assignee: LX SEMICON CO., LTD., Daejeon (KR)

( * ) Notice: Subject to any disclaimer, the term of this patent is extended or adjusted under 35 U.S.C. 154(b) by 0 days.

(21) Appl. No.: 17/317,385

(22) Filed: May 11, 2021

(65) Prior Publication Data

US 2021/0358426 A1 Nov. 18, 2021

(30) Foreign Application Priority Data

May 12, 2020 (KR) ..... 10-2020-0056624

(51) Int. Cl.
*G09G 3/34* (2006.01)

(52) U.S. Cl.
CPC ... *G09G 3/3406* (2013.01); *G09G 2320/0233* (2013.01); *G09G 2320/0626* (2013.01); *G09G 2360/16* (2013.01)

(58) Field of Classification Search
CPC ..... G09G 3/3648; G09G 3/36; G09G 3/3406; G09G 2320/0233; G09G 2320/0626; G09G 2300/023; G09G 2300/02; G09G 2360/16; G09G 2320/0238
See application file for complete search history.

(56) References Cited

U.S. PATENT DOCUMENTS

| | | | | |
|---|---|---|---|---|
| 9,864,243 | B2 | 1/2018 | Erinjippurath et al. | |
| 2007/0126688 | A1* | 6/2007 | Woo | G09G 3/3688 345/100 |
| 2019/0355330 | A1* | 11/2019 | Lin | G09G 3/2003 |
| 2020/0320941 | A1* | 10/2020 | Ge | G09G 3/3607 |

FOREIGN PATENT DOCUMENTS

| | | | |
|---|---|---|---|
| JP | 2007-286413 | A | 11/2007 |
| KR | 10-0758986 | B1 | 9/2007 |
| KR | 10-2011-0097390 | A | 8/2011 |
| KR | 10-2018-0034214 | A | 4/2018 |

* cited by examiner

*Primary Examiner* — Dennis P Joseph
(74) *Attorney, Agent, or Firm* — Hyunho Park

(57) ABSTRACT

A display driving device for improving the definition of an image according to one aspect of the present invention includes a brightness calculator for calculating first brightness data corresponding to a first resolution and second brightness data corresponding to a second resolution less than the first resolution using input image data, an offset calculator for calculating an offset on the basis of the first brightness data and the second brightness data, an input image converter for converting the input image data into input image data to which the calculated offset has been applied, a first data output unit for generating output image data for a first panel using the converted input image data and outputting the generated output image data, and a second data output unit for generating output brightness data for a second panel using the second brightness data and outputting the generated output brightness data.

19 Claims, 10 Drawing Sheets

DISPLAY DRIVING DEVICE AND DRIVING METHOD

FIELD

The present invention relates to a display, and more specifically, to control of brightness of images displayed on a display.

BACKGROUND

With the development of multimedia technology, various types of display devices such as smartphones and tablet devices in addition to conventional television systems have been developed and spread. Particularly, a large-screen display device has recently been used as an instrument panel in means of transportation such as a vehicle. Further, various displays such as a liquid crystal display (LCD), a plasma display panel (PDP), and an organic light emitting display (OLED) have recently been used.

A conventional LCD includes a backlight that provides light and a liquid crystal panel that displays images. Since the backlight provides light with uniform brightness, the liquid crystal panel has a high offset brightness when realizing a black level. Korean Patent No. 10-0758986 (hereinafter referred to as Patent Literature 1) discloses a liquid crystal display in which an additional second liquid crystal panel is provided between a backlight that provides light and a first liquid crystal panel that displays images to achieve high-quality image representation with high contrast.

However, the first liquid crystal panel may have a resolution higher than that of the second liquid crystal panel in Patent Literature 1. In this case, there is a problem of occurrence of blur at an edge of an image.

PATENT LITERATURE

Patent Literature 1: Korean Patent No. 10-0758986 (Title of Invention: Dual liquid crystal display)

SUMMARY

Therefore, the present invention has been made in view of the above problems, and it is an object of the present invention to provide a display driving device and driving method capable of preventing occurrence of blur at an edge of an image.

It is another object of the present invention to provide a display driving device and driving method for causing a liquid crystal display device to provide high contrast and to perform display for improving perceptual resolution of images.

In accordance with one aspect of the present invention, the above and other objects can be accomplished by the provision of a display driving device including: a brightness calculator for calculating first brightness data corresponding to a first resolution and second brightness data corresponding to a second resolution less than the first resolution using input image data; an offset calculator for calculating an offset on the basis of the first brightness data and the second brightness data; an input image converter for converting the input image data into input image data to which the calculated offset has been applied; a first data output unit for generating output image data for a first panel using the converted input image data and outputting the generated output image data; and a second data output unit for generating output brightness data for a second panel using the second brightness data and outputting the generated output brightness data.

In accordance with another aspect of the present invention, there is provided a display driving method for controlling brightness of an image in response to surrounding illuminance, the display driving method including: calculating first brightness data corresponding to a first resolution and second brightness data corresponding to a second resolution less than the first resolution using input image data; calculating an offset on the basis of the first brightness data and the second brightness data; converting the input image data into input image data to which the calculated offset has been applied; and generating output image data for a first panel using the converted input image data and generating output brightness data for a second panel using the second brightness data.

DETAILED DESCRIPTION

Figure 1:
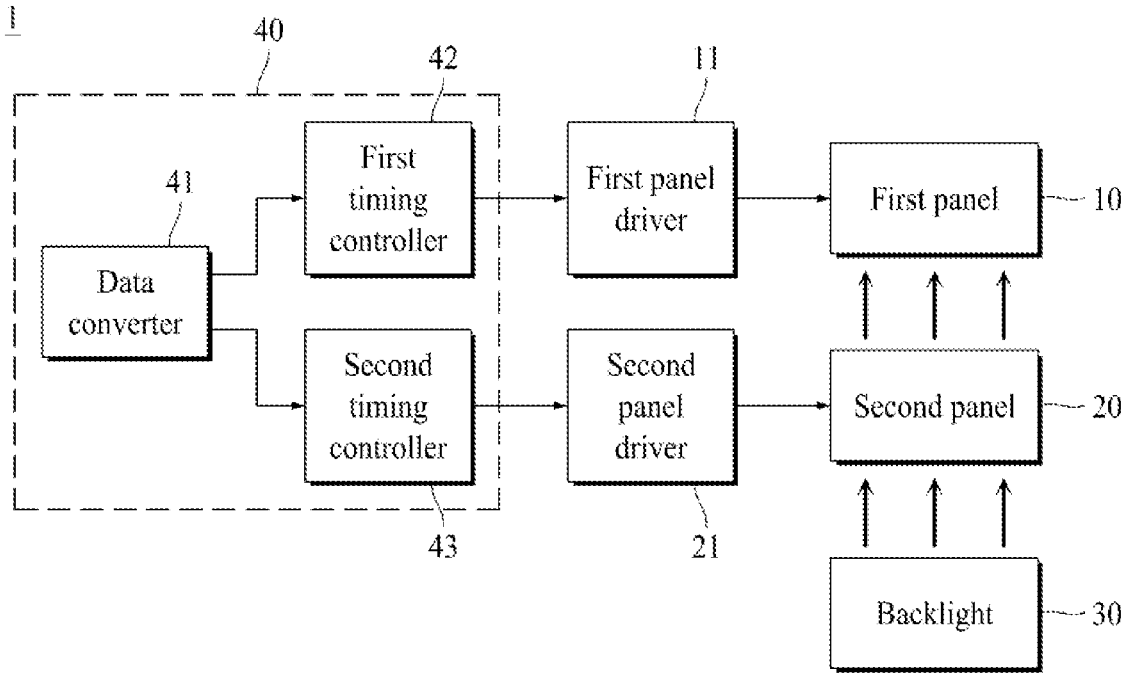
FIG. 1 is a diagram schematically showing a configuration of a display system according to an embodiment of the present invention.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Furthermore, the present disclosure is only defined by scopes of claims.

A shape, a size, a ratio, an angle, and a number disclosed in the drawings for describing embodiments of the present disclosure are merely an example, and thus the present disclosure is not limited to the illustrated details. Like reference numerals refer to like elements throughout. In the following description, when the detailed description of the relevant known technology is determined to unnecessarily obscure the important point of the present disclosure, the detailed description will be omitted.

In a case where 'comprise', 'have', and 'include' described in the present specification are used, another part may be added unless 'only' is used. The terms of a singular form may include plural forms unless referred to the contrary.

In construing an element, the element is construed as including an error range although there is no explicit description.

In describing a positional relationship, for example, when a position relation between two parts is described as 'on~', 'over~', 'under~', and 'next~', one or more other parts may be disposed between the two parts unless 'just' or 'direct' is used.

In describing a time relationship, for example, when the temporal order is described as 'after~', 'subsequent~', 'next~', and 'before~', a case which is not continuous may be included unless 'just' or 'direct' is used.

It will be understood that, although the terms "first," "second," etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

Terms such as first and second can be used to describe elements of the present disclosure. These terms are only used to distinguish one element from another element, and essentials, sequences, orders, or numbers of the elements are not limited by the terms. When an element is described as being "connected," "coupled," or "linked" to another element, it should be understood that the element may be connected or coupled directly to another element, still another element may be "interposed" between the elements, or the elements may be "connected," "coupled," or "linked" to each other via still another element.

"X-axis direction", "Y-axis direction" and "Z-axis direction" should not be construed by a geometric relation only of a mutual vertical relation, and may have broader directionality within the range that elements of the present disclosure may act functionally.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Features of various embodiments of the present disclosure may be partially or totally coupled to or combined with each other, and may be variously inter-operated and driven technically. The embodiments of the present disclosure may be carried out independently from each other or may be carried out together with a co-dependent relationship.

Reference will now be made in detail to the exemplary embodiments of the present disclosure, examples of which are illustrated in the accompanying drawings. Wherever possible, the same reference numbers will be used throughout the drawings to refer to the same or like parts.

Figure 2:
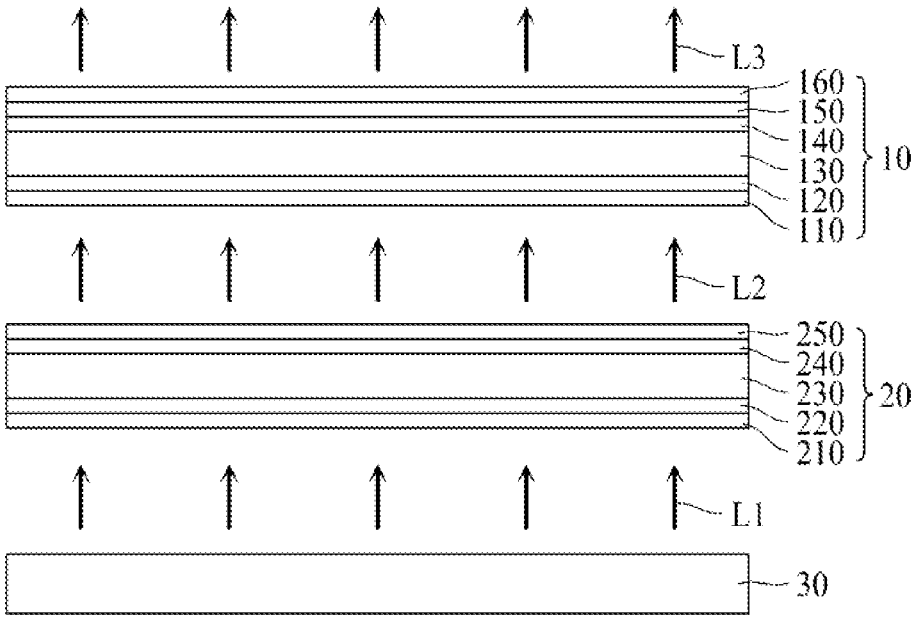
FIG. 2 is a diagram schematically showing configurations of a first panel, a second panel, and a backlight of FIG. 1.
Figure 3:
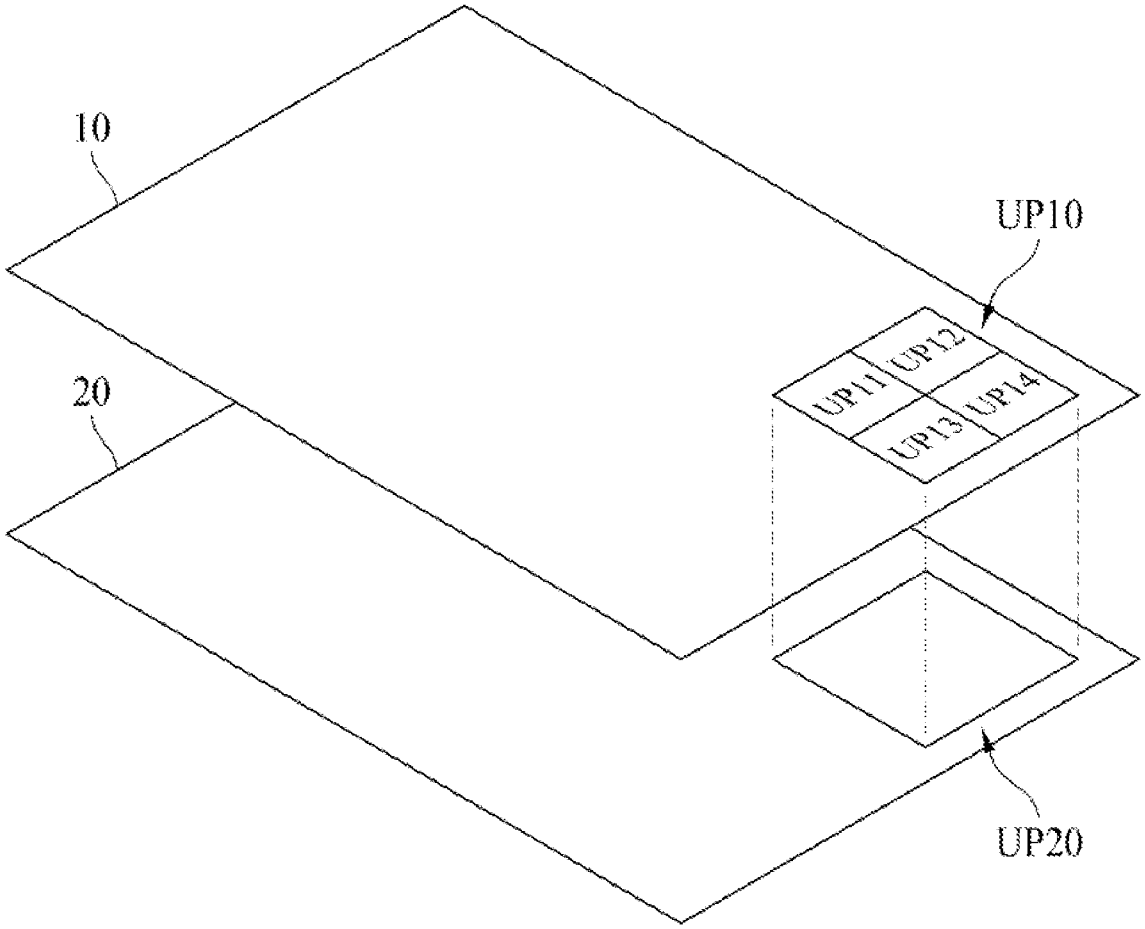
FIG. 3 is a diagram for describing a first unit pixel of the first panel and a second unit pixel of the second panel.

FIG. 1 is a diagram schematically showing a configuration of a display system according to an embodiment of the present invention, FIG. 2 is a diagram schematically showing configurations of a first panel, a second panel, and a backlight of FIG. 1, and FIG. 3 is a diagram for describing a first unit pixel of the first panel and a second unit pixel of the second panel.

As illustrated in FIG. 1 and FIG. 2, a display system 1 to which a display driving device according to an embodiment of the present invention is applied includes a first panel 10, a second panel 20, a backlight 30, a first panel driver 11, a second panel driver 21, and a display driving device 40.

The first panel 10 includes a plurality of first unit pixels UP10 and can display color images. Each of the plurality of first unit pixels UP10 may include a plurality of subpixels having different colors. For example, each of the plurality of first unit pixels UP10 may include a red subpixel, a green subpixel, and a blue subpixel, but the present invention is not limited thereto. As another example, each of the plurality of first unit pixels UP10 may include a red subpixel, a green subpixel, a blue subpixel, and a white subpixel. In an embodiment, subpixels may be repeatedly formed in a row direction or formed in a 2*2 matrix form.

The first panel 10 according to an embodiment of the present invention may be a liquid crystal panel including a first lower substrate 110, a first lower electrode 120, a first liquid crystal layer 130, a first upper electrode 140, a plurality of color filters 150, and a first upper substrate 160.

Specifically, the first lower substrate 110 may be a transparent substrate and may include a plurality of thin film transistors formed at intersections of a plurality of gate lines and a plurality of data lines. Each of the plurality of thin film transistors provides a data signal supplied through a data line to a corresponding subpixel in response to a scan pulse supplied through a gate line.

The first lower electrode 120 can be provided on the first lower substrate 110 on which the plurality of thin film transistors is formed and connected to the plurality of thin film transistors. The first upper electrode 140 can be formed on the first upper substrate 160. The first liquid crystal layer 130 is provided between the first lower electrode 120 and the first upper electrode 140. The first liquid crystal layer 130 can be aligned according to vertical electric fields formed between the first lower electrode 120 and the first upper electrode 140. The first panel 10 can control the transmittance of light L2 radiated from the second panel 20 according to alignment of the first liquid crystal layer 130.

In addition, the first panel 10 includes the plurality of color filters 150 formed on the first upper substrate 160 to correspond to subpixels. The color filters 150 corresponding to colors can be provided to respectively correspond to the subpixels to represent colors. For example, color filters 150 corresponding to red, green, and blue can be provided to respectively correspond to a red subpixel, a green subpixel, and a blue subpixel, but the present invention is not limited thereto. As another example, color filters 150 corresponding to red, green, blue, and white can be provided to respectively correspond to a red subpixel, a green subpixel, a blue subpixel, and a white subpixel. A color filter may not be provided for a white subpixel.

In the first panel 10, the quantity of the light L2 radiated from the second panel 20 changes while the light L2 passes through the liquid crystal layer 130, and then the light L2 changes to color light L3 while passing through the color filters 150 and is radiated to the outside. Accordingly, the first panel 10 can display a color image.

The second panel 20 may include a plurality of unit pixels UP20 and display monochrome images. The second unit pixel UP20 is larger than the first unit pixel UP10. Each second unit pixel UP20 may correspond to two or more first unit pixels UP10. For example, a single second unit pixel UP20 can correspond to four first unit pixels UP11, UP12, UP13, and UP14, as illustrated in FIG. 3. Here, the size of the single second unit pixel UP20 can equal the size of the four first unit pixels UP11, UP12, UP13, and UP14.

As described above, the second panel 20 includes the second unit pixels UP20 larger than the first unit pixels UP10 included in the first panel 10 and thus may have a resolution lower than that of the first panel 10. The first panel 10 may include the plurality of first unit pixels UP10 and have a first resolution, whereas the second panel 20 may include the plurality of second unit pixels UP20 and have a second resolution lower than the first resolution. For example, when a single second unit pixel UP20 corresponds to four first unit pixels UP11, UP12, UP13, and UP14, as illustrated in FIG. 3, the resolution of the second panel 20 may be a quarter of the resolution of the first panel 10.

The second panel 20 according to an embodiment of the present invention may be a liquid crystal panel including a second lower substrate 210, a second lower electrode 220, a second liquid crystal layer 230, a second upper electrode 240, and a second upper substrate 250.

Specifically, the second lower substrate 210 may be a transparent substrate and may include a plurality of thin film transistors formed at intersections of a plurality of gate lines and a plurality of data lines. Each of the plurality of thin film transistors provides a data signal supplied through a data line to a corresponding second unit pixel UP20 in response to a scan pulse supplied through a gate line.

The second lower electrode 220 can be provided on the second lower substrate 210 on which the plurality of thin film transistors is formed and connected to the plurality of thin film transistors. The second upper electrode 240 can be formed on the second upper substrate 250. The second liquid crystal layer 230 is provided between the second lower electrode 220 and the second upper electrode 240. The second liquid crystal layer 230 can be aligned according to vertical electric fields formed between the second lower electrode 220 and the second upper electrode 240. The second panel 20 can control the transmittance of light L1 radiated from the backlight 30 according to alignment of the second liquid crystal layer 230.

The second panel 20 may not include color filters unlike the first panel 10. Accordingly, the second panel 20 does not realize color images and can control only the quantity of light to be provided to the first panel 10 by adjusting the transmittance of the light L1 radiated from the backlight 30.

The backlight 30 provides light. The backlight 30 includes a plurality of light sources. The plurality of light sources may be controlled as a whole, but the present invention is not limited thereto. The backlight 30 may include a plurality of light sources which may be independently controlled.

Specifically, the backlight 30 can generate uniform initial light L1 through the plurality of light sources. The backlight 30 is provided under the second panel 20 and radiates the initial light L1 to the bottom side of the second panel 20. The transmittance of the light L1 radiated from the backlight 30 to the bottom side of the second panel 20 can be primarily controlled by the second liquid crystal layer 230 of the second panel 20, and then the light having the controlled transmittance can be radiated to the bottom side of the first panel 10. The transmittance of the light L2 radiated from the second panel 20 to the bottom side of the first panel 10 can be secondarily controlled by the first liquid crystal layer 130 of the first panel 10, and then the light having the controlled transmittance can be emitted to the outside. Here, the light having the transmittance controlled by the first liquid crystal layer 130 of the first panel 10 has colors after passing through the color filters 150. Accordingly, the first panel 10 can display a color image.

The display system 1 according to an embodiment of the present invention can effectively block light emitted from the backlight 30 when a black level is represented since the transmittance of light is controlled in the second panel 20 and the first panel 10. Accordingly, the display system 1 according to an embodiment of the present invention can display high-quality images with high contrast.

Although the second panel 20 is provided between the first panel 10 and the backlight 30 in FIG. 1 and FIG. 2, the present invention is not limited thereto. In another embodiment, the second panel 20 can be provided on the first panel 10. That is, the first panel 10 can be provided between the second panel 20 and the backlight 30. In this case, the backlight 30 is provided under the first panel 10 and radiates initial light to the bottom side of the first panel 10. The transmittance of the light radiated from the backlight 30 to the bottom side of the first panel 10 can be primarily controlled by the first liquid crystal layer 130 of the first panel 10, and then the light with the controlled transmittance can be radiated to the bottom side of the second panel 20. Here, the light having the transmittance controlled by the first liquid crystal layer 130 of the first panel 10 can be converted into color light while passing through the color filters 150. The transmittance of the color light radiated from the first panel 10 to the bottom side of the second panel 20 can be secondarily controlled by the second liquid crystal layer 230 of the second panel 20, and then the light with the controlled transmittance can be emitted to the outside.

The display system 1 according to an embodiment of the present invention may further include a polarization film (not shown) provided at least one of on the first panel 10, between the first panel 10 and the second panel 20, and between the second panel 20 and the backlight 30 in order to use the polarization property of light.

The first panel driver 11 receives a control signal from the display driving device 40 and controls driving of the first panel 10. To this end, the first panel driver 11 includes a first gate driver and a first data driver.

The first gate driver can generate gate signals for driving the gate lines of the first panel 10 in response to a gate control signal input from the display driving device 40. The first gate driver can provide the generated gate signals to the subpixels of the first unit pixels UP10 included in the first panel 10 through the gate lines.

The first data driver can receive a data control signal and an image data signal from the display driving device 40. The first data driver can convert the image data signal in a digital form into an image data signal in an analog form in response to the data control signal input from the display driving device 40. The first data driver can provide the converted image data signal to the subpixels of the first unit pixels UP10 included in the first panel 10 through the data lines.

The second panel driver 21 receives a control signal from the display driving device 40 and controls driving of the second panel 20. To this end, the second panel driver 21 includes a second gate driver and a second data driver.

The second gate driver can generate gate signals for driving the gate lines of the second panel 20 in response to a gate control signal input from the display driving device 40. The second gate driver can provide the generated gate signals to the second unit pixels UP20 included in the second panel 20 through the gate lines.

The second data driver can receive a data control signal and a brightness data signal from the display driving device 40. The second data driver can convert the brightness data signal in a digital form into a brightness data signal in an analog form in response to the data control signal input from the display driving device 40. The second data driver can provide the converted brightness data signal to the second unit pixels UP20 included in the second panel 20 through the data lines.

The display driving device 40 includes a data converter 41, a first timing controller 42, and a second timing controller 43.

The data converter 41 converts input image data input from an external system into output image data for the first panel 10 having a first resolution, and outputs the output image data to the first timing controller 42. Further, the data converter 41 converts the input image data input from the external system into output brightness data for the second panel 20 having a second resolution and outputs the output brightness data to the second timing controller 43. The data converter 41 will be described in detail later with reference to FIG. 4 to FIG. 6.

The first timing controller 42 receives a timing signal from the data converter 41 and generates a control signal for controlling the first panel driver 11. Specifically, the first timing controller 42 can receive various timing signals including a vertical synchronization signal, a horizontal synchronization signal, a data enable signal, and a clock signal. The first timing controller 42 can generate the data control signal for controlling the data driver of the first panel driver 11 and the gate control signal for controlling the gate driver of the first panel driver 11.

The first timing controller 42 can receive output image data from the data converter 41 and generate an image data signal based on the received output image data. Here, the image data signal may be a digital signal converted into a data signal format that can be processed by the data driver of the first panel driver 11.

The first timing controller 42 can output the data control signal, the gate control signal, and the image data signal to the first panel driver 11.

The second timing controller 43 can receive a timing signal from the data converter 41 and generate a control signal for controlling the second panel driver 21. Specifically, the second timing controller 43 can receive various timing signals including the vertical synchronization signal, the horizontal synchronization signal, the data enable signal, and the clock signal. The second timing controller 43 can generate the data control signal for controlling the data driver of the second panel driver 21 and the gate control signal for controlling the gate driver of the second panel driver 21.

The second timing controller 43 can receive output brightness data from the data converter 41 and generate a brightness data signal based on the received output brightness data. Here, the brightness data signal may be a digital signal converted into a data signal format that can be processed by the data driver of the second panel driver 21.

The second timing controller 43 can output the data control signal, the gate control signal, and the brightness data signal to the second panel driver 21.

Hereinafter, the data converter 41 will be described in detail with reference to FIG. 4 to FIG. 8.

Figure 4:
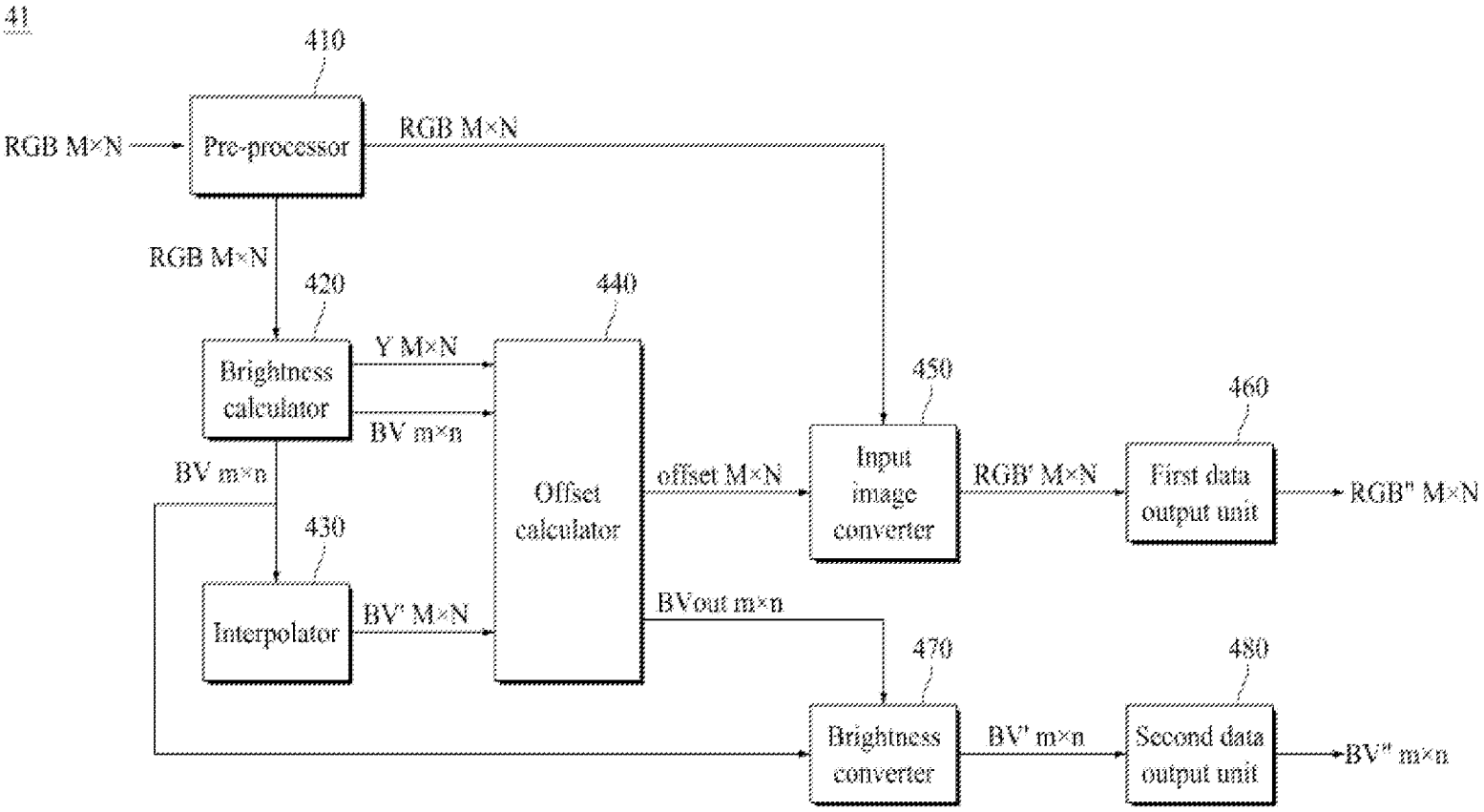
FIG. 4 is a diagram showing a configuration of a data converter of FIG. 1.
Figure 5:
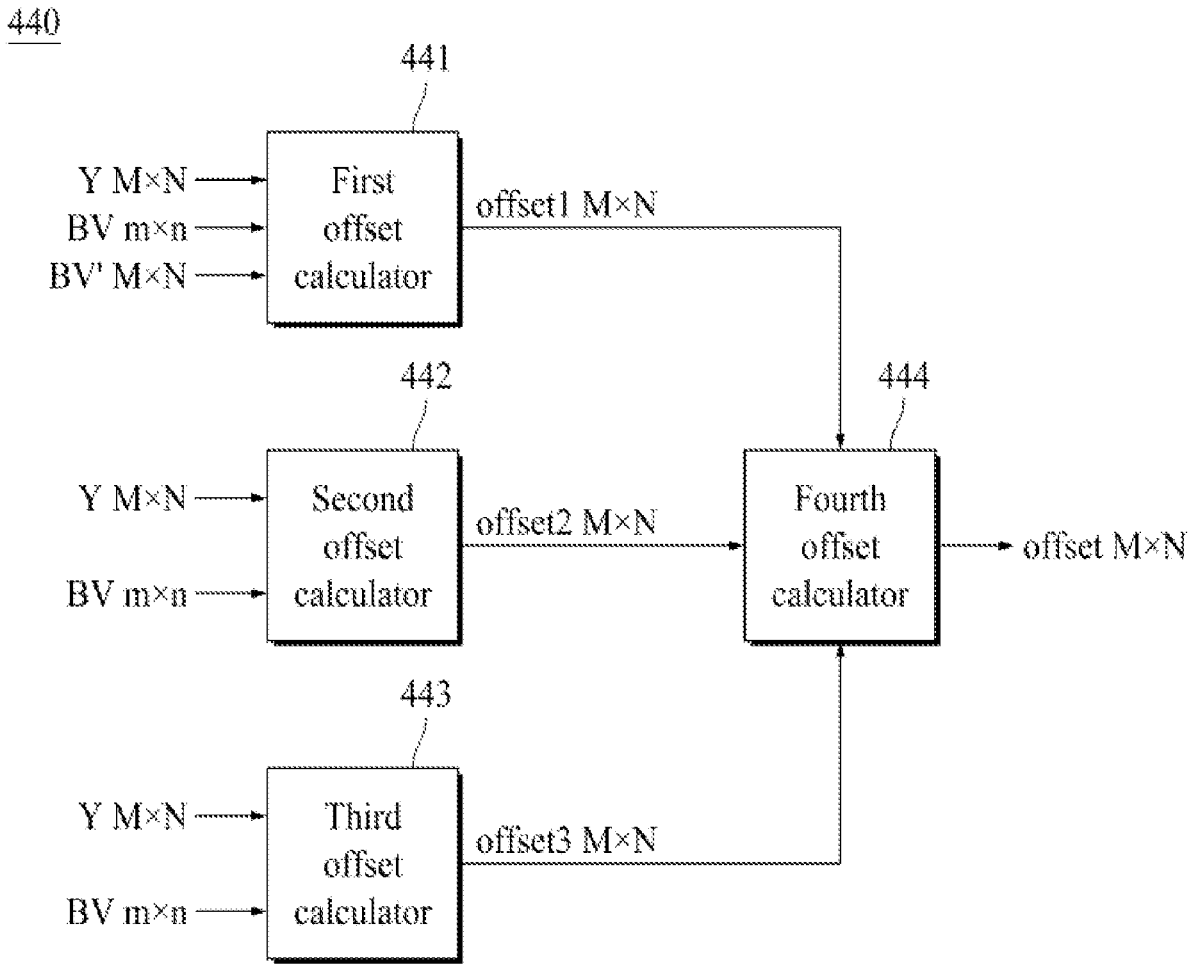
FIG. 5 is a diagram showing a configuration of an offset calculator of FIG. 4.
Figure 6:
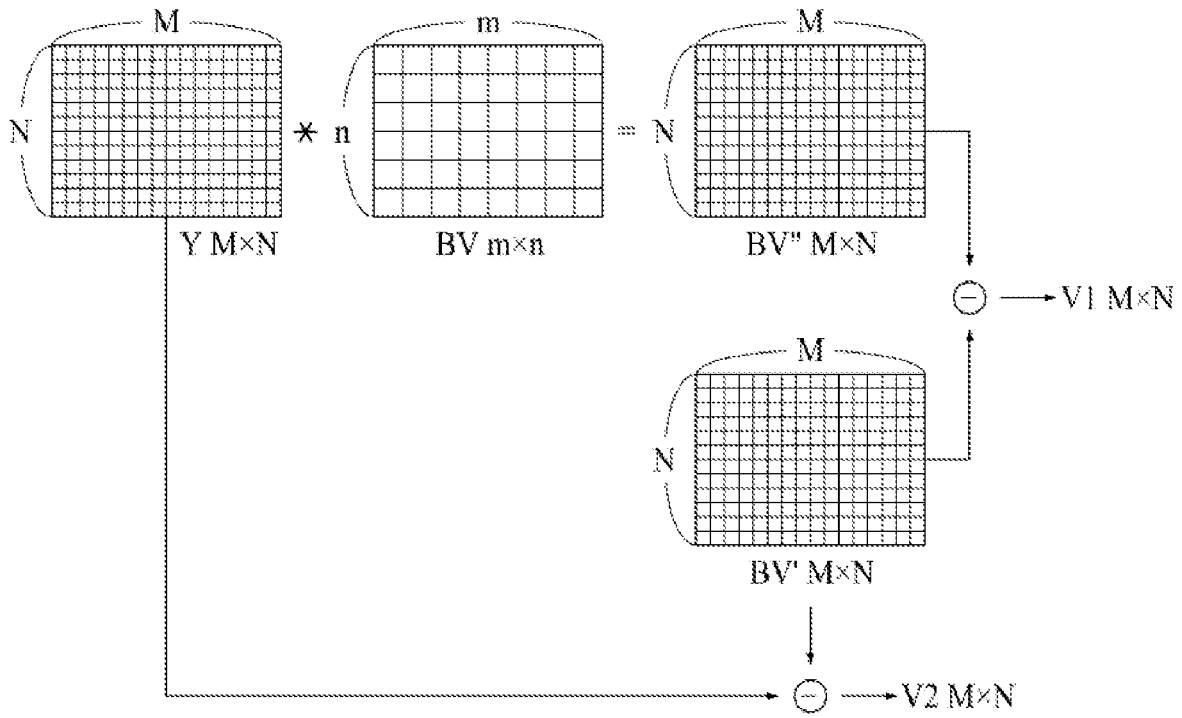
FIG. 6 is a diagram for describing a method for calculating a first offset in a first offset calculator of FIG. 5.
Figure 7:
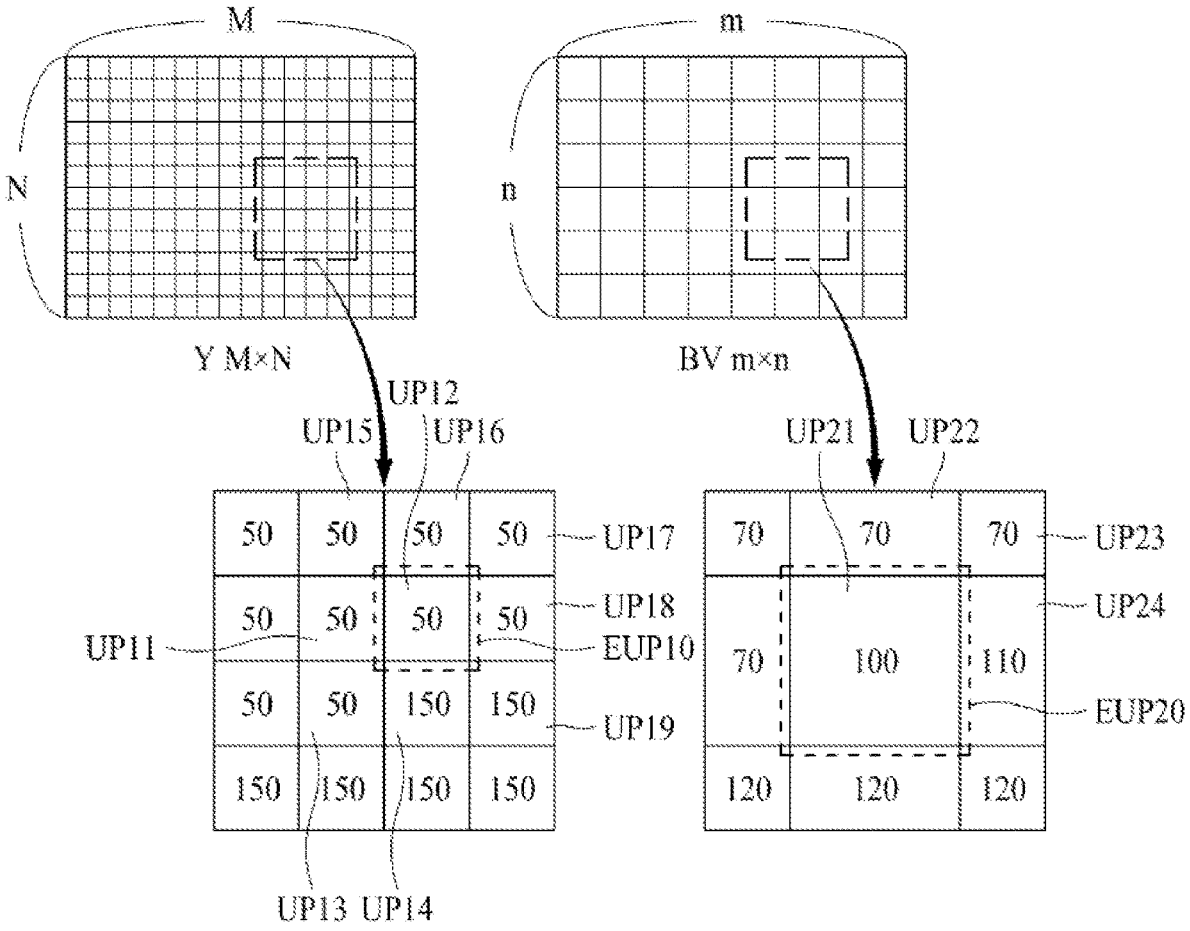
FIG. 7 is a diagram for describing a method for calculating a second offset in a second offset calculator and a method for calculating a third offset in a third offset calculator in FIG. 5.
Figure 8:
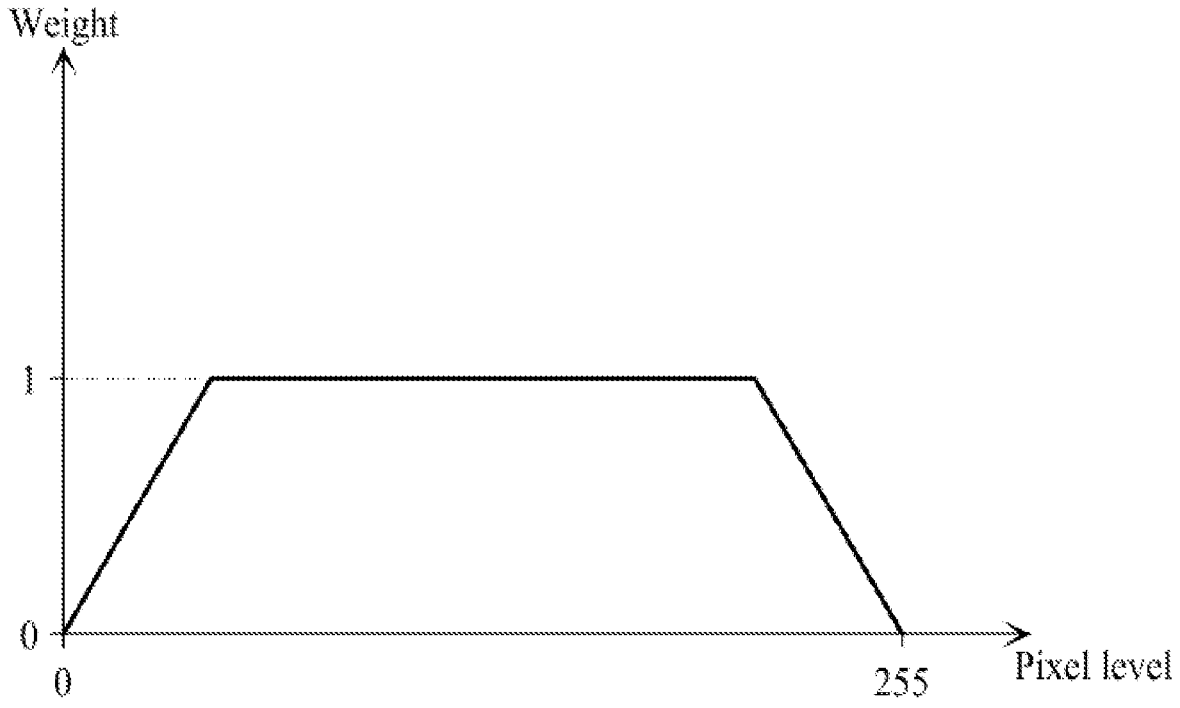
FIG. 8 is a graph showing a weight per brightness level.

FIG. 4 is a diagram showing a configuration of the data converter of FIG. 1, and FIG. 5 is a diagram showing a configuration of an offset calculator of FIG. 4. FIG. 6 is a diagram for describing a method for calculating a first offset in a first offset calculator of FIG. 5, and FIG. 7 is a diagram for describing a method for calculating a second offset in a second offset calculator and a method for calculating a third offset in a third offset calculator in FIG. 5. FIG. 8 is a graph showing a weight per brightness level.

Referring to FIG. 4 to FIG. 8, the data converter 41 includes a pre-processor 410, a brightness calculator 420, an interpolator 430, an offset calculator 440, an input image converter 450, a first data output unit 460, a brightness converter 470, and a second data output unit 480.

The pre-processor 410 pre-processes input image data RGB M×N input from an external system and provides the pre-processed data to the brightness calculator 420. Specifically, the pre-processor 410 can receive nonlinear input image data RGB M×N from the external system. Here, the input image data RGB M×N corresponds to 3-color source image data corresponding to the first resolution.

The pre-processor 410 can convert the nonlinear input image data RGB M×N into linear input image data RGB M×N. In an embodiment, the pre-processor 410 can convert the nonlinear input image data RGB M×N into the linear input image data RGB M×N using an inverse function of a gamma curve.

The brightness calculator 420 calculates first brightness data Y M×N corresponding to the first resolution and second brightness data BV m×n corresponding to the second resolution on the basis of the linear input image data RGB M×N.

Specifically, the brightness calculator 420 can calculate brightness values for the plurality of first unit pixels UP10 included in the first panel 10 on the basis of the linear input image data RGB M×N.

In an embodiment, the brightness calculator 420 can convert the 3-color input image data RGB M×N into brightness components Y and chrominance components CbCr. Here, the brightness calculator 420 can generate the first brightness data Y M×N including a brightness component Y of each unit pixel UP10. The operation of the brightness calculator 420 is not limited to using a brightness component Y obtained by applying weights to red (R), green (G), and blue (B) and summing the weights. The brightness calculator 420 can calculate a maximum value among red (R), green (G), and blue (B) as a brightness value or calculate a mean of red (R), green (G), and blue (B) as a brightness value. The brightness calculator 420 can calculate a brightness value through various known methods.

The brightness calculator 420 can calculate brightness values for the plurality of second unit pixels UP20 included in the second panel on the basis of the linear input image data RGB M×N.

In an embodiment, the brightness calculator 420 can calculate a brightness value for a second unit pixel UP20 using brightness values of a plurality of first unit pixels UP10 disposed at a position corresponding to the second unit pixel UP20. For example, the brightness calculator 420 can calculate a mean brightness value of the plurality of first unit pixels UP10 disposed at the position corresponding to the second unit pixel UP20. For example, a single second unit pixel UP20 can correspond to four first unit pixels UP10. In this case, the brightness calculator 420 can calculate a mean of brightness values of the four first unit pixels UP10 disposed at the position corresponding to the second unit pixel UP20 and generate second brightness data BV m×n including the calculated mean as a brightness value of the second unit pixel UP20.

However, the present invention is not limited thereto, and the brightness calculator 420 can calculate a brightness value of a second unit pixel UP20 using brightness values of a plurality of first unit pixels UP20 disposed at a position corresponding to the second unit pixel UP20 through various methods.

The brightness calculator 420 provides the first brightness data Y M×N and the second brightness data BV m×n to the offset calculator 440 and provides the second brightness data BV m×n to the interpolator 430.

The interpolator 430 performs interpolation based on the second brightness data BV m×n corresponding to the second resolution to generate first interpolated brightness data BV' M×N corresponding to the first resolution. The interpolator 430 can generate the first interpolated brightness data BV' M×N for a plurality of third unit pixels using the brightness values of the plurality of second unit pixels UP20. Here, the plurality of third unit pixels is arbitrary unit pixels for generating the first interpolated brightness data BV' M×N and may have the same size, number, and positional relationship as the plurality of first unit pixels UP10 of the first panel 10.

In an embodiment, the interpolator 430 may determine a brightness value of a second unit pixel UP20 as a brightness value of each of a plurality of third unit pixels corresponding to the second unit pixel UP20. In another embodiment, the interpolator 430 can determine one of values between a brightness value of a certain second unit pixel UP20 and a brightness value of a second unit pixel UP20 adjacent to the certain unit pixel UP20 as a brightness value of one of a plurality of third unit pixels corresponding to the certain second unit pixel UP20. However, the present invention is not limited thereto, and the interpolator 430 can generate the first interpolated brightness data BV' M×N corresponding to the first resolution using the brightness values of the plurality of second unit pixels UP20 through various methods.

The interpolator 430 provides the generated first interpolated brightness data BV' M×N to the offset calculator 440.

The offset calculator 440 calculates an offset offset M×N for each of the plurality of first unit pixels UP10 on the basis of the first brightness data Y M×N corresponding to the first resolution and the second brightness data BV m×n corresponding to the second resolution. The offset calculator 440 includes a first offset calculator 441, a second offset calculator 442, a third offset calculator 443, and a fourth offset calculator 444, as illustrated in FIG. 5.

The first offset calculator 441 calculates a first offset offset1 for each of the plurality of first unit pixels UP10 on the basis of the first brightness data Y M×N corresponding to the first resolution, the second brightness data BV m×n corresponding to the second resolution, and the first interpolated brightness data BV' M×N corresponding to the first resolution.

Specifically, the first offset calculator 441 can generate second interpolated brightness data BV" M×N corresponding to the first resolution by performing interpolation on the basis of the first brightness data Y M×N corresponding to the first resolution and the second brightness data BV m×n corresponding to the second resolution, as illustrated in FIG. 6.

In an embodiment, the first offset calculator 441 can generate the second interpolated brightness data BV" M×N corresponding to the first resolution by performing joint bilateral filtering on the first brightness data Y M×N corresponding to the first resolution and the second brightness data BV m×n corresponding to the second resolution.

The first offset calculator 441 calculates a difference between a brightness value of the second interpolated brightness data BV" M×N and a brightness value of the first interpolated brightness data BV' M×N as a first value V1 M×N. In addition, the first offset calculator 441 can calculate a difference between a brightness value of the first brightness data Y M×N and a brightness value of the first interpolated brightness data BV' M×N as a second value V2 M×N.

In an embodiment, the first offset calculator 441 can calculate the first offset offset1 for a corresponding unit pixel using the first value V1 and the second value V2 according to the following equation 1.

$$\text{offset1}=\alpha\times V_1+\beta\times V_2 \quad \text{[Equation 1]}$$

Here, offset1 represents the first offset, $V_1$ represents the first value, and $V_2$ represents the second value. In addition, $\alpha$ and $\beta$ are greater than 0 and less than 1, and the sum of $\alpha$ and $\beta$ is a constant satisfying 1.

The first offset calculator 441 can generate first offset data offset1 M×N including the first offset offset1 for each of the plurality of first unit pixels UP10. The first offset calculator 441 can provide the first offset data offset1 M×N to the fourth offset calculator 444.

The second offset calculator 442 calculates a second offset offset2 for first unit pixels UP10 corresponding to an edge of an image. The second offset calculator 442 calculates the second offset offset2 for each of the plurality of first unit pixels UP10 on the basis of the first brightness data Y M×N corresponding to the first resolution and the second brightness data BV m×n corresponding to the second resolution.

Specifically, the second offset calculator 442 can determine a first edge unit pixel EUP10 corresponding to an edge of an image from among the plurality of first unit pixels UP10. The second offset calculator 442 can determine a second edge unit pixel EUP20 disposed at a position corresponding to the first edge unit pixel EUP10 from among the plurality of second unit pixels UP20.

In addition, the second offset calculator 442 can calculate an expected brightness value for the second edge unit pixel EUP20. The second offset calculator 442 can calculate the expected brightness value for the second edge unit pixel EUP20 by applying weights to brightness values of second unit pixels disposed adjacent to the second edge unit pixel EUP20. The second offset calculator 442 can calculate the second offset offset2 on the basis of a brightness value of the first edge unit pixel EUP10, the expected brightness value for the second edge unit pixel EUP20, and an edge intensity of the first edge unit pixel EUP10.

Hereinafter, a method for calculating the expected brightness value for the second edge unit pixel EUP20 and a method for calculating the second offset offset2 for the first edge unit pixel EUP10 will be described through specific examples.

Referring to FIG. 7, it is assumed that a single second unit pixel UP20 corresponds to four first unit pixels UP10. For example, a single second unit pixel UP21 may correspond to four first unit pixels UP11, UP12, UP13, and UP14.

The second offset calculator 442 can determine the first unit pixel UP12 corresponding to an edge of an image from among the plurality of first unit pixels UP10 as the first edge unit pixel EUP10, as illustrated in FIG. 7. The second offset calculator 442 can determine the second unit pixel UP21 disposed at a position corresponding to the first edge unit pixel EUP10 from among the plurality of second unit pixels UP20 as the second edge unit pixel EUP20.

The second offset calculator 442 can calculate weights $W_1$, $W_2$, $W_3$, $W_4$, and $W_5$ for a plurality of first unit pixels UP15, UP16, UP17, UP18, and UP19 disposed adjacent to the first edge unit pixel EUP10. In an embodiment, a weight can be calculated through a predetermined function according to the following equation 2.

$$W=f(x,y) \quad \text{[Equation 2]}$$

Here, x corresponds to a brightness value of the first edge unit pixel EUP10 and y corresponds to a brightness value of any one of the first neighboring unit pixels UP15, UP16, UP17, UP18, and UP19 disposed adjacent to the first edge unit pixel EUP10. W corresponds to weights for the first neighboring unit pixels UP15, UP16, UP17, UP18, and UP19.

For example, five first unit pixels UP15, UP16, UP17, UP18, and UP19 may be disposed adjacent to the first edge unit pixel EUP10. In this case, $W_1$, $W_2$, $W_3$, $W_4$, and $W_5$ for the five first neighboring unit pixels UP15, UP16, UP17, UP18, and UP19 can be calculated according to the following equation 3.

$$W_1=f(50,50)$$

$$W_2=f(50,50)$$

$$W_3=f(50,50)$$

$$W_4=f(50,50)$$

$$W_4=f(50,50) \quad \text{[Equation 3]}$$

$W_1$, $W_2$, $W_3$, $W_4$, and $W_5$ are greater than 0 and less than 1, and the sum of $W_1$, $W_2$, $W_3$, $W_4$, and $W_5$ is a value satisfying 1.

Then, the second offset calculator 442 can calculate an expected brightness value for the second edge unit pixel EUP20 by applying weights to brightness values of second unit pixels disposed adjacent to the second edge unit pixel EUP20. To this end, the second offset calculator 442 can determine second unit pixels UP22, UP22, UP23, UP24, and UP24 disposed at positions corresponding to the first neighboring unit pixels UP15, UP16, UP17, UP18, and UP19 disposed adjacent to the first edge unit pixel EUP10 from among the plurality of second unit pixels UP20 as second neighboring unit pixels.

The second offset calculator 442 can calculate the expected brightness value for the second edge unit pixel EUP20 by multiplying brightness values of the second neighboring unit pixels UP22, UP22, UP23, UP24, and UP24 by the weights $W_1$, $W_2$, $W_3$, $W_4$, and $W_5$ and summing the multiplication results.

The expected brightness value for the second edge unit pixel EUP20 illustrated in FIG. 7 can be calculated according to the following equation 4.

$$\text{EBV}=\text{BV}_1\times W_1+\text{BV}_2\times W_2+\text{BV}_3\times W_3+\text{BV}_4\times W_4+\text{BV}_5\times W_5 \quad \text{[Equation 4]}$$

$BV_1$ corresponds to a brightness value of the second neighboring unit pixel UP22 disposed at a position corresponding to the first neighboring unit pixel UP15, and $W_1$ corresponds to a weight for the first neighboring unit pixel UP15. $BV_2$ corresponds to a brightness value of the second neighboring unit pixel UP22 disposed at a position corresponding to the first neighboring unit pixel UP16, and $W_2$ corresponds to a weight for the first neighboring unit pixel UP16. $BV_3$ corresponds to a brightness value of the second neighboring unit pixel UP23 disposed at a position corresponding to the first neighboring unit pixel UP17, and $W_3$ corresponds to a weight for the first neighboring unit pixel UP17. $BV_4$ corresponds to a brightness value of the second neighboring unit pixel UP24 disposed at a position corresponding to the first neighboring unit pixel UP18, and $W_4$ corresponds to a weight for the first neighboring unit pixel UP18. $BV_5$ corresponds to a brightness value of the second neighboring unit pixel UP24 disposed at a position corresponding to the first neighboring unit pixel UP19, and $W_5$ corresponds to a weight for the first neighboring unit pixel UP19. EBV corresponds to the expected brightness value for the second edge unit pixel EUP20.

In an embodiment, the second offset calculator 442 can calculate the second offset offset2 by multiplying a difference between the brightness value of the first edge unit pixel EUP10 and the expected brightness value of the second edge unit pixel EUP20 by an edge intensity. Specifically, the second offset calculator 442 can calculate the second offset offset2 for the first edge unit pixel EUP10 according to the following equation 5.

$$\text{offset2}=\alpha\times(Y-\text{EBV})\times\text{EI} \quad \text{[Equation 5]}$$

Y corresponds to the brightness value of the first edge unit pixel EUP10, EBV corresponds to the expected brightness value of the second edge unit pixel EUP20, and EI corresponds to an edge intensity of the first edge unit pixel EUP10. $\alpha$ is a constant and a positive number.

The edge intensity represents a degree of likelihood of a corresponding first unit pixel UP10 being the first edge unit pixel EUP10 and can be calculated from the 3-color input image data RGB M×N through various known methods.

The second offset calculator 441 can generate second offset data offset2 M×N including the second offset offset2 for each of the plurality of first unit pixels UP10.

In an embodiment, the second offset calculator 441 can set the second offset offset2 for first unit pixels UP10 that do not correspond to the first edge unit pixel EUP10 to 0.

The second offset calculator 442 can provide the second offset data offset2 M×N to the fourth offset calculator 444.

The third offset calculator 443 calculates a third offset offset3 for increasing or decreasing a brightness value in consideration of brightness deviations in a plurality of first unit pixels UP10 corresponding to each second unit pixel UP20. The third offset calculator 443 calculates the third offset offset3 for each of the plurality of first unit pixels UP10 on the basis of the first brightness data Y M×N corresponding to the first resolution and the second brightness data BV m×n corresponding to the second resolution.

Specifically, the third offset calculator 443 can check brightness deviations in the plurality of first unit pixels UP10 corresponding to each second unit pixel UP20. When the number of first unit pixels UP10 having negative brightness deviations differs from the number of first unit pixels UP10 having positive brightness deviations, the third offset calculator 443 can calculate the third offset offset3 for increasing or decreasing brightness values of the plurality of first unit pixels UP10 corresponding to the corresponding second unit pixel UP20.

Hereinafter, a method for calculating the third offset offset3 will be described through specific examples.

Referring to FIG. 7, it is assumed that a single unit pixel UP20 corresponds to four first unit pixels UP10. For example, a single second unit pixel UP21 can correspond to four first unit pixels UP11, UP12, UP13, and UP14.

The third offset calculator 443 can check brightness deviations in a plurality of first unit pixels UP10 corresponding to each second unit pixel UP20. When there are three first unit pixels UP11, UP12, and UP13 having negative brightness deviations and a single first unit pixel UP14 having a positive brightness deviation, as illustrated in FIG. 7, the third offset calculator 443 can calculate the third offset offset3 for increasing or decreasing brightness values of the first unit pixels UP11, UP12, UP13, and UP14 corresponding to the second unit pixel UP21.

Although a case in which the number of first unit pixels UP10 having negative brightness deviations is greater than the number of first unit pixels UP10 having positive brightness deviations is described in FIG. 7, the present invention is not limited thereto. The third offset calculator 443 can also calculate the third offset offset3 for increasing or decreasing brightness values of a plurality of first unit pixels UP10 corresponding to a corresponding second unit pixel UP20 when the number of first unit pixels UP10 having negative brightness deviations is less than the number of first unit pixels UP10 having positive brightness deviations.

When the number of first unit pixels UP10 having negative brightness deviations is greater than the number of first unit pixels UP10 having positive brightness deviations, the third offset offset3 can have a value of less than 0 to decrease brightness values of a plurality of first unit pixels UP10 corresponding to a corresponding second unit pixel UP20. On the other hand, when the number of first unit pixels UP10 having negative brightness deviations is less than the number of first unit pixels UP10 having positive brightness deviations, the third offset offset3 can have a value greater than 0 to increase brightness values of a plurality of first unit pixels UP10 corresponding to a corresponding second unit pixel UP20.

The third offset calculator 443 can calculate the third offset offset3 for each of the plurality of first unit pixels UP11, UP12, UP13, and UP14 corresponding to the second unit pixel UP21. Although a method for calculating the third offset offset3 for the first unit pixel UP12 will be described below for convenience of description, the third offset calculator 443 can calculate the third offset offset3 for other first unit pixels UP11, UP13, and UP14 through the same method.

To calculate the third offset, the third offset calculator 443 can calculate a brightness change value with respect to the second unit pixel UP21 corresponding to the first unit pixel UP11 and calculate the third offset offset3 on the basis of the calculated brightness change value.

Specifically, the third offset calculator 443 can extract first neighboring unit pixels UP15, UP16, UP17, and UP18 having deviations from the brightness value of the first unit pixel UP11 within a predetermined range from among the first neighboring unit pixels UP15, UP16, UP17, UP18, and UP19 disposed adjacent to the first unit pixel UP11. The first neighboring unit pixel UP19 has a brightness value of 150 that has a large deviation from the brightness value of 50 of the first unit pixel UP11 and thus may not be extracted.

The third offset calculator 443 can calculate a mean brightness value of the second neighboring unit pixels UP22, UP22, UP23, and UP24 respectively corresponding to the extracted first neighboring unit pixels UP15, UP16, UP17, and UP18. The third offset calculator 443 can add the brightness value of the second unit pixel UP21 to a deviation between the calculated mean brightness value and the brightness value of the second unit pixel UP21 to calculate the brightness change value.

In an embodiment, the third offset calculator 443 can calculate the brightness change value with respect to the second unit pixel UP21 according to the following equation 6.

$$BV_{out}=BV+\alpha+\times mean(ABV)-BV) \quad \text{[Equation 6]}$$

BV represents the brightness value of the second unit pixel UP20, and mean(ABV) represents a mean brightness value of second unit pixels UP20 respectively corresponding to first neighboring unit pixels UP10 having deviations from the brightness value of a corresponding first unit pixel UP10 within a predetermined range. $\alpha$ is a constant greater than 0 and equal to or less than 1. $BV_{out}$ represents a brightness change value with respect to a corresponding second unit pixel UP20.

The third offset calculator 443 can calculate the third offset offset3 on the basis of a difference between the brightness change value with respect to the corresponding second unit pixel UP20 and the brightness value of the corresponding second unit pixel UP20.

In an embodiment, the third offset calculator 443 can calculate the third offset offset3 for the corresponding first unit pixel UP10 according to the following equation 7.

$$offset3=\beta\times(BV_{out}-BV) \quad \text{[Equation 7]}$$

$BV_{out}$ represents the brightness change value with respect to the corresponding second unit pixel UP20, and BV represents the brightness value of the corresponding second unit pixel UP20. $\beta$ is a constant and a positive number greater than 0.

The third offset calculator 443 can generate third offset data offset3 M×N including the third offset offset3 for each of the plurality of first unit pixels UP10.

In an embodiment, the third offset calculator 443 can check brightness deviations in the plurality of first unit pixels UP10 corresponding to each second unit pixel UP20 and set the third offset offset3 for each of the plurality of first unit pixels UP10 corresponding to the corresponding unit pixel UP20 to 0 when the number of first unit pixels UP11, UP12, and UP13 having negative brightness deviations is equal to the number of first unit pixels UP14 having a positive brightness deviation.

The third offset calculator 443 can provide the generated third offset data offset3 M×N to the fourth offset calculator 444.

Further, the third offset calculator 443 can generate brightness change data $BV_{out}$ m×n including brightness change values $BV_{out}$ with respect to the plurality of second unit pixels UP20.

In an embodiment, the third offset calculator 443 can check brightness deviations in the plurality of first unit pixels UP10 corresponding to each second unit pixel UP20 and set the brightness change value $BV_{out}$ with respect to the corresponding second unit pixel UP20 to the corresponding brightness value BV when the number of first unit pixels UP11, UP12, and UP13 having negative brightness deviations is equal to the number of first unit pixels UP14 having a positive brightness deviation.

The third offset calculator 443 can provide the brightness change data $BV_{out}$ m×n to the brightness converter 470.

The fourth offset calculator 444 calculates a fourth offset based on the first offset offset1, the second offset offset2, and the third offset offset3. Specifically, the fourth offset calculator 444 can receive the first offset data offset1 M×N from the first offset calculator 441, receive the second offset data offset2 M×N from the second offset calculator 441, and receive the third offset data offset3 M×N from the third offset calculator 441.

The fourth offset calculator 444 can calculate the fourth offset for a corresponding first unit pixel UP10 by summing the first offset offset1, the second offset offset2, and the third offset offset3.

In an embodiment, the fourth offset calculator 444 can calculate the fourth offset for the corresponding first unit pixel UP10 according to the following equation 8.

$$offset=(offset1+offset2+offset3)\times W \quad \text{[Equation 8]}$$

offset1 represents the first offset for the corresponding first unit pixel UP10, offset2 represents the second offset for the corresponding first unit pixel UP10, offset3 represents the third offset for the corresponding first unit pixel UP10, and offset represents the fourth offset for the corresponding first unit pixel UP10.

W represents a weight according to a brightness value of the corresponding first unit pixel UP10. When a brightness value is low or high, the weight can be applied to the brightness value such that the brightness value can exceed or become less than a brightness value that the first unit pixel UP can have. For example, a brightness value may be within a 0 to 255. When the brightness value of a corresponding first unit pixel UP10 is 255, the brightness value of the corresponding first unit pixel UP10 exceeds 255 if a positive offset is applied to the brightness value of the corresponding first unit pixel UP10. That is, the corresponding first unit pixel UP10 has a brightness value beyond the determined brightness range.

To prevent this, the fourth offset calculator 444 according to an embodiment of the present invention can calculate the fourth offset by applying a weight to a brightness value. Here, the weight W can have a value less than 1 when the brightness value falls within a low range, for example, 0 to 20, or a high range, for example, 235 to 255, as illustrated in FIG. 8. Here, the weight may linearly increase or decrease, as illustrated in FIG. 8, but the present invention is not limited thereto. The weight may increase or decrease in a curved form such as the Sigmoid function or other nonlinear functions.

The fourth offset calculator 444 can generate fourth offset data offset M×N including the fourth offset for each of the plurality of first unit pixels UP10. The fourth offset calculator 444 can provide the generated fourth offset data offset M×N to the input image converter 450.

The input image converter 450 converts input image data RGB M×N into input image data RGB' M×N to which an offset has been applied. Specifically, the input image converter 450 can receive the linearized input image data RGB M×N from the pre-processor 410 and receive the fourth offset data offset M×N from the offset calculator 440. The input image converter 450 can generate converted input image data RGB' M×N on the basis of the input image data RGB M×N and the fourth offset data offset M×N.

In an embodiment, the input image converter 450 can convert the input image data RGB M×N received from the pre-processor 410 into brightness components Y and chrominance components CbCr for the plurality of first unit pixels UP10. The input image converter 450 can apply the fourth offset to the brightness components Y with respect to the plurality of first unit pixels UP10. The input image converter 450 can generate the input image data RGB' M×N to which the fourth offset has been applied on the basis of the brightness components Y' to which the fourth offset has been applied and the chrominance components CbCr.

In another embodiment, the input image converter 450 can receive data regarding the brightness components Y and the chrominance components CbCr for the plurality of first unit pixels UP10 from the brightness calculator 420. The input image converter 450 can apply the fourth offset to the brightness components Y received from the brightness calculator 420. The input image converter 450 can generate the input image data RGB' M×N to which the fourth offset has been applied on the basis of the brightness components Y' to which the fourth offset has been applied and the chrominance components CbCr.

The first data output unit 460 post-processes the input image data RGB' M×N converted by the input image converter 450 to generate output image data RGB" M×N for the first panel 10. The first data output unit 460 outputs the output image data RGB" M×N to the first timing controller 42.

Specifically, the first data output unit 460 can receive the converted linear input image data RGB' M×N from the input image converter 450. The first data output unit 460 can convert the converted linear input image data RGB' M×N into converted nonlinear input image data RGB' M×N.

In an embodiment, the first data output unit 460 can convert the linear input image data RGB' M×N into the nonlinear output image data RGB" M×N using a gamma curve function. The first data output unit 460 can gamma-correct the input image data RGB' M×N received from the input image converter 450 into the output image data RGB" M×N suitable for the first timing controller 42 using a lookup table.

The first data output unit 460 outputs the nonlinear output image data RGB" M×N to the first timing controller 42.

Although the 3-color output image data RGB" M×N is output to the first timing controller 42 in FIG. 4, the present invention is not limited thereto. In another embodiment, the first data output unit 460 may output 4-color output image data to the first timing controller 42. The first data output unit 460 can receive the converted 3-color input image data RGB' M×N from the input image converter 450. The first data output unit 460 can convert the converted 3-color input image data RGB' M×N into 4-color input image data. The first data output unit 460 can gamma-correct the converted 4-color input image data into 4-color output image data suitable for the first timing controller 42 using a lookup table. The first data output unit 460 can output the nonlinear 4-color output image data to the first timing controller 42.

The brightness converter 470 converts the second brightness data BV m×n into second brightness data BV' m×n to which the brightness change value $BV_{out}$ has been applied. Specifically, the brightness converter 470 can receive the second brightness data BV m×n from the brightness calculator 420 and receive the brightness change data $BV_{out}$ m×n from the offset calculator 440. The brightness converter 470 can generate the converted second brightness data BV' m×n on the basis of the second brightness data BV m×n and the brightness change data $BV_{out}$ m×n. Here, the second brightness data BV m×n includes the brightness values of the plurality of second unit pixels UP20 and the brightness change data $BV_{out}$ m×n includes brightness change values of the plurality of second unit pixels UP20.

The brightness converter 470 can set a value calculated on the basis of the brightness value and the brightness change value of each second unit pixel UP20 to the brightness values of each second unit pixel UP20.

In an embodiment, the brightness converter 470 can apply a weight to the brightness value and the brightness change value of each second unit pixel UP20 and set the sum of the brightness value and the brightness change value to which the weight has been applied to the brightness value of each second unit pixel UP20.

In another embodiment, the brightness converter 470 can set a value between the brightness value and the brightness change value of each second unit pixel UP20 to the brightness value of each second unit pixel UP20.

The second data output unit 480 generates output brightness data BV" M×N for the second panel 20 on the basis of the second brightness data BV' M×N converted by the brightness converter 470. The second data output unit 480 outputs the output brightness data BV" M×N to the second timing controller 43.

The data converter 41 according to an embodiment of the present invention can prevent occurrence of blur at an edge of an image by applying an offset to the output image data RGB" M×N output to the first panel 10. Therefore, according to the present invention, an edge of an image displayed on the first panel 10 can become clear and perceptual resolution can be improved.

Furthermore, the data converter 41 according to an embodiment of the present invention can control a brightness value at an edge of an image more accurately for the first panel 10 and cause the edge of the image to become clear by calculating a final offset in consideration of a plurality of offsets offset1, offset2, and offset3. That is, the present invention can improve the definition of an image.

Moreover, the data converter 41 according to an embodiment of the present invention can represent brightness more effectively in the second panel 20 by controlling a brightness value of a second unit pixel UP20 according to a distribution of a plurality of first unit pixels UP10 corresponding to the second unit pixel UP20.

Figure 9A:
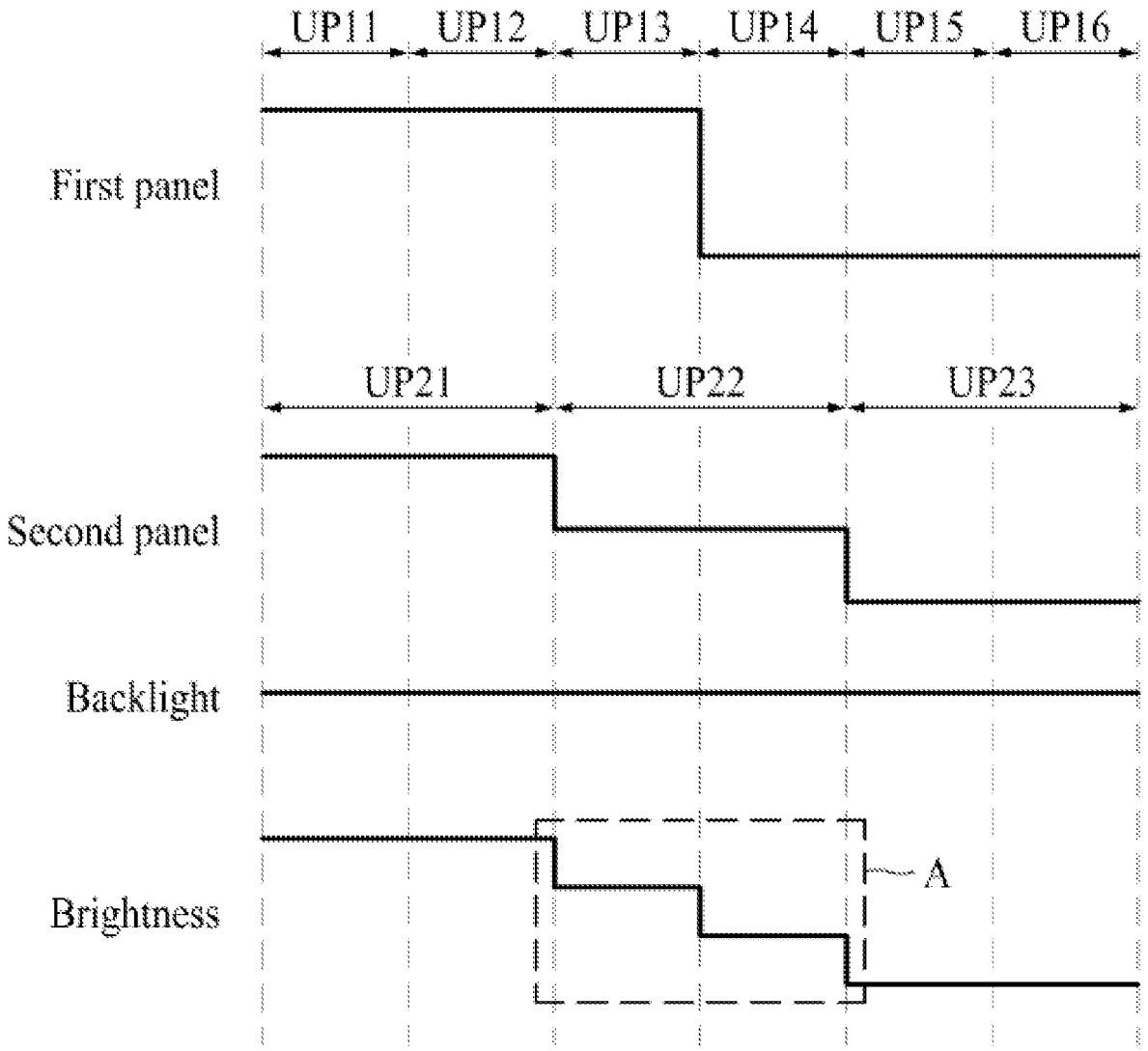
FIG. 9*a* is a diagram showing an example in which an offset is not applied to image data.
Figure 9B:
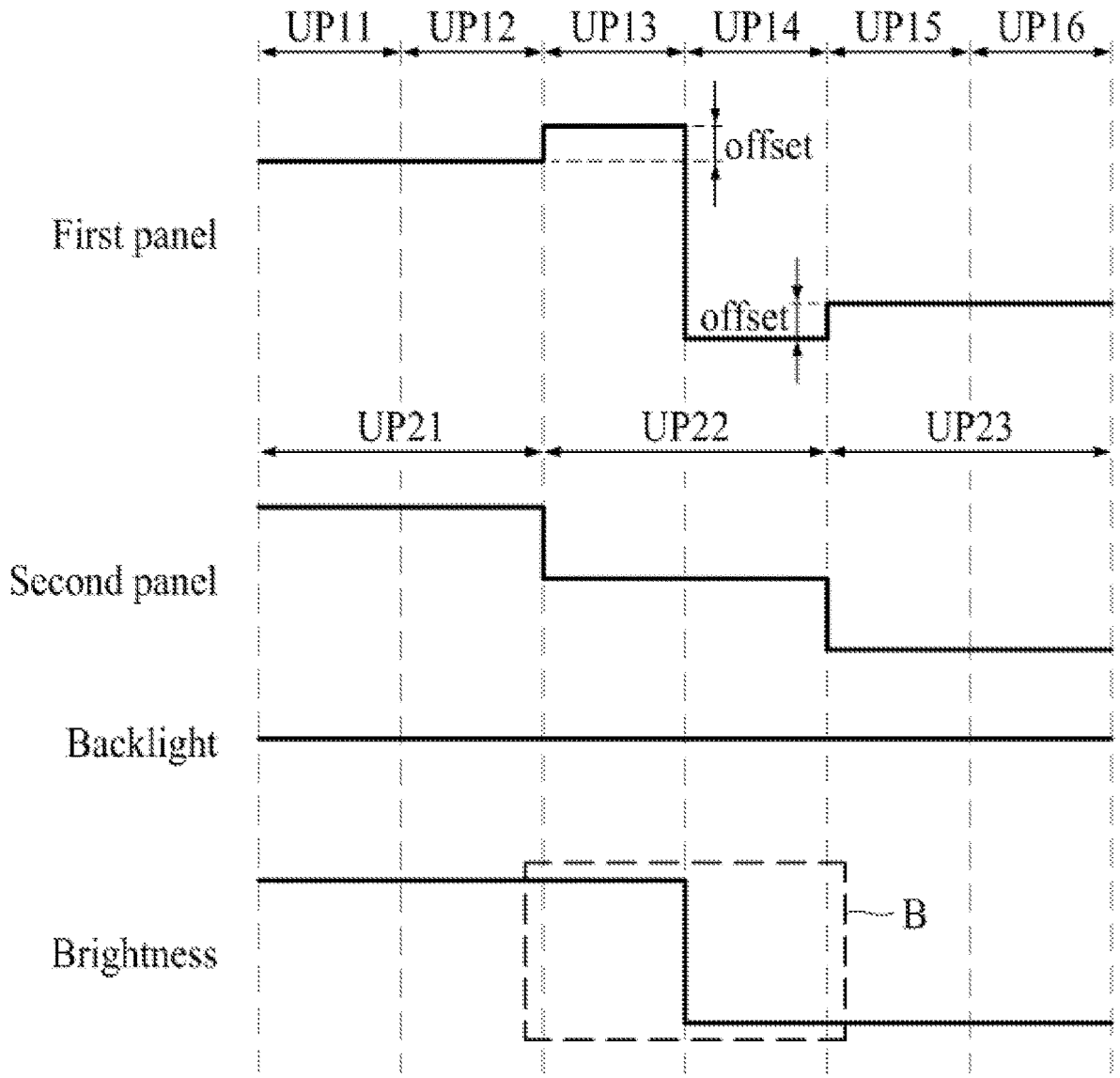
FIG. 9*b* is a diagram showing an example in which an offset is applied to image data.

FIG. 9*a* is a diagram showing an example in which an offset is not applied to image data and FIG. 9*b* is a diagram showing an example in which an offset is applied to image data.

Referring to FIG. 9*a* and FIG. 9*b*, the display system 1 according to an embodiment of the present invention includes the first panel 10 having the first resolution, the second panel 20 having the second resolution, and the backlight 30.

The first panel 10 includes a plurality of first unit pixels. The second panel 20 includes a plurality of second unit pixels, and each second unit pixel may correspond to a plurality of first unit pixels. For convenience of description, it is assumed that a single second unit pixel corresponds to two first unit pixels.

For example, a single second unit pixel UP21 may correspond to two first unit pixels UP11 and UP12, another second unit pixel UP22 may correspond to two first unit pixels UP13 and UP14, and another second unit pixel UP23 may correspond to two first unit pixels UP15 and UP16.

The first panel 10 may have different brightness values for the first unit pixels UP11, UP12, UP13, UP14, UP15, and UP16. In the first panel 10, three first unit pixels UP11, UP12, and UP13 included in a first group may have the same brightness value and the remaining three first unit pixels UP14, UP15, and UP16 included in a second group may have the same brightness value, as illustrated in FIG. 9*a*. The first group and the second group may have a large brightness value deviation therebetween.

The second panel 20 may have difference brightness values for the second unit pixels UP21, UP22, and UP23. In the second panel 20, the second unit pixels UP21, UP22, and UP23 may have different brightness values, as illustrated in FIG. 9*a*.

The backlight 30 may have a constant brightness value for all pixels.

Since brightness values decrease in stages in an area A of FIG. 9*a*, an image is displayed to a user as if it is blurred through the display system 1 including the first panel 10, the second panel 20, and the backlight 30. This is because the two first unit pixels UP13 and UP14 corresponding to the single second unit pixel UP22 have different brightness values having a large deviation therebetween, whereas the single second unit pixel UP22 has a single brightness value.

That is, due to a difference between the resolutions of the first panel 10 and the second panel 20, the first unit pixels UP11, UP12, UP13, UP14, UP15, and UP16 included in the first panel 10 have a size different from that of the second unit pixels UP21, UP22, and UP23 included in the second panel 20, to cause occurrence of blurring.

According to the display system 1 according to an embodiment of the present invention can apply an offset to the brightness values of first edge unit pixels UP13 and UP14 corresponding to an edge from among the first unit pixels UP11, UP12, UP13, UP14, UP15, and UP16 of the first panel 10.

In such a case, a brightness value sharpness can increase, as represented in an area B of FIG. 9*b*, in the display system 1 including the first panel 10, the second panel 20, and the backlight 30. Accordingly, it is possible to prevent occurrence of blurring as in the area A of FIG. 9*a*.

Figure 10:
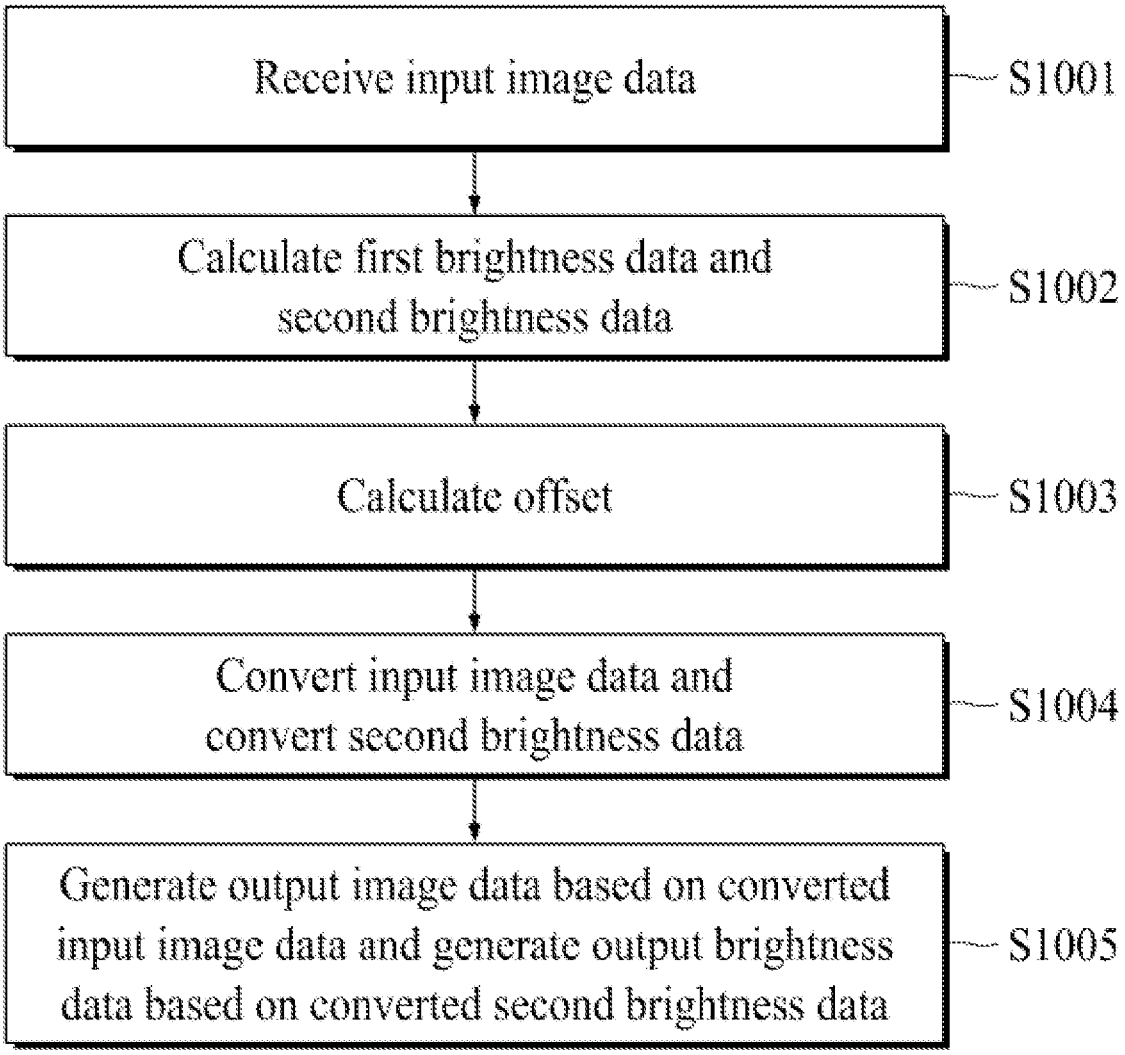
FIG. 10 is a flowchart showing a display driving method according to an embodiment of the present invention.

FIG. 10 is a flowchart showing a display driving method according to an embodiment of the present invention.

First, the display system 1 receives input image data RGB M×N from an external system (S1001). Here, the input image data RGB M×N received from the external system is nonlinear data corresponding to 3-color source image data having the first resolution.

Next, the display system 1 calculates first brightness data Y M×N corresponding to the first resolution and second brightness data BV m×n corresponding to the second resolution on the basis of the input image data RGB M×N (S1002).

Specifically, the display system 1 can convert the nonlinear input image data RGB M×N into linear input image data RGB M×N. In an embodiment, the pre-processor 410 can convert the nonlinear input image data RGB M×N into the linear input image data RGB M×N using an inverse function of a gamma curve.

Thereafter, the display system 1 can calculate the first brightness data Y M×N corresponding to the first resolution and the second brightness data BV m×n corresponding to the second resolution on the basis of the linear input image data RGB M×N.

The display system 1 can calculate a brightness value of each of the plurality of first unit pixels included in the first panel 10 on the basis of the linear input image data RGB M×N. In an embodiment, the display system 1 can convert the 3-color input image data RGB M×N into brightness components Y and chrominance components CbCr. Here, the display system 1 can generate the first brightness data Y M×N including brightness components Y of the first unit pixels. The display system 1 is not limited to using brightness components Y obtained by applying weights to red (R), green (G), and blue (B) and summing the resultant values. The display system 1 may calculate a maximum value among red (R), green (G), and blue (B) as a brightness value or calculate a mean of red (R), green (G), and blue (B) as a brightness value. The display system 1 can calculate a brightness value through various known methods.

In addition, the display system 1 can calculate a brightness value of each of the plurality of second unit pixels included in the second panel 20 on the basis of the linear input image data RGB M×N. In an embodiment, the display system 1 can calculate a brightness value of a second unit pixel using brightness value of a plurality of first unit pixels disposed at a position corresponding to the second unit pixel.

Next, the display system 1 calculates an offset for each of the plurality of first unit pixels on the basis of the first brightness data Y M×N corresponding to the first resolution and the second brightness data BV m×n corresponding to the second resolution (S1003).

The display system 1 can calculate a first offset, a second offset, and a third offset.

The first offset can be calculated on the basis of the first brightness data Y M×N corresponding to the first resolution, the second brightness data BV m×n corresponding to the second resolution, and first interpolated brightness data BV' M×N corresponding to the first resolution.

Specifically, the display system 1 can generate second interpolated brightness data BV" M×N corresponding to the first resolution by performing interpolation based on the first brightness data Y M×N corresponding to the first resolution and the second brightness data BV m×n corresponding to the second resolution. In an embodiment, the display system 1 can generate the second interpolated brightness data BV" M×N by performing joint bilateral filtering on the first brightness data Y M×N corresponding to the first resolution and the second brightness data BV m×n corresponding to the second resolution.

The display system 1 can calculate a difference between a brightness value of the second interpolated brightness data BV" M×N and a brightness value of the first interpolated brightness data BV' M×N as a first value V1 M×N and calculate a difference between a brightness value of the first brightness data Y M×N and the brightness value of the first interpolated brightness data BV' M×N as a second value V2 M×N. The display system 1 can calculate the first offset for the corresponding first unit pixel using the aforementioned equation 1.

Further, the second offset can be calculated on the basis of the first brightness data Y M×N corresponding to the first resolution and the second brightness data BV m×n corresponding to the second resolution.

Specifically, the display system 1 can determine a first edge unit pixel corresponding to an edge of an image from among the plurality of first unit pixels and determine a second edge unit pixel disposed at a position corresponding to the first edge unit pixel from among the plurality of second unit pixels.

Then, the display system 1 can calculate an expected brightness value for the second edge unit pixel. The display system 1 can calculate the expected brightness value for the second edge unit pixel by applying a weight to brightness values of second unit pixels disposed adjacent to the second edge unit pixel.

The display system 1 can calculate the second offset on the basis of a brightness value of the first edge unit pixel, the expected brightness value of the second edge unit pixel, and an edge intensity of the first edge unit pixel. In an embodiment, the second offset can be calculated by multiplying a difference between the brightness value of the first edge unit pixel and the expected brightness value of the second edge unit pixel by the edge intensity. The display system 1 can calculate the second offset for the corresponding first unit pixel using the aforementioned equation 5.

Further, the third offset can be calculated on the basis of the first brightness data Y M×N corresponding to the first resolution and the second brightness data BV m×n corresponding to the second resolution.

Specifically, the display system 1 can check brightness deviations in a plurality of first unit pixels corresponding to each second unit pixel. When the number of first unit pixels having negative brightness deviations differs from the number of first unit pixels having positive brightness deviations, the display system 1 can calculate a brightness change value with respect to the corresponding second unit pixel.

To calculate the brightness change value, the display system 1 can extract first neighboring unit pixels having brightness deviations from a brightness value of the corresponding first unit pixel within a predetermined range from among first neighboring unit pixels disposed adjacent to the corresponding first unit pixel. The display system 1 can calculate a mean brightness value of second neighboring unit pixels corresponding to the extracted first neighboring unit pixels. The display system 1 can calculate the brightness change value by adding a brightness value of the corresponding second unit pixel to a deviation between the calculated mean brightness value and the brightness value of the corresponding second unit pixel. In an embodiment, the display system 1 can calculate the brightness change value with respect to the corresponding second unit pixel according to the aforementioned equation 6.

The display system 1 can calculate the third offset on the basis of a difference between the brightness change value with respect to the corresponding second unit pixel and the brightness value of the corresponding second unit pixel. In an embodiment, the display system 1 can calculate the third offset for the corresponding first unit pixel according to the aforementioned equation 7.

Thereafter, the display system 1 can calculate a fourth offset on the basis of the first offset, the second offset, and the third offset.

The display system 1 can calculate the fourth offset for the corresponding first unit pixel by summing the first offset, the second offset, and the third offset and applying a weight depending on a brightness value to the sum. In an embodiment, the display system 1 can calculate the fourth offset for the corresponding first unit pixel according to the aforementioned equation 8.

Next, the display system 1 converts the input image data RGB M×N into input image data RGB' M×N to which the fourth offset has been applied and converts the second brightness data BV m×n into second brightness data BV' m×n to which the brightness change value $BV_{out}$ has been applied (S1004).

The display system 1 can generate the converted input image data RGB' M×N on the basis of the input image data RGB M×N and fourth offset data offset M×N. The display system 1 can convert the input image data RGB M×N into brightness components Y and chrominance components CbCr for the plurality of first unit pixels. Then, the display system 1 can apply the fourth offset to the brightness components Y for the plurality of first unit pixels. The display system 1 can generate the input image data RGB' M×N to which the fourth offset has been applied on the basis of the brightness components Y' to which the fourth offset has been applied and the chrominance components CbCr.

In addition, the display system 1 can generate the converted second brightness data BV' m×n on the basis of the second brightness data BV m×n and brightness change data $BV_{out}$ m×n. Here, the second brightness data BV m×n includes the brightness values of the plurality of second unit pixels and the brightness change data $BV_{out}$ m×n includes brightness change values of the plurality of second unit pixels.

The display system 1 can change the brightness value of the corresponding second unit pixel UP20 to a value calculated on the basis of the brightness value and the brightness change value of each of the plurality of second unit pixels. In an embodiment, the display system 1 can change the brightness value of a second unit pixel to a value obtained by applying a weight to the brightness value and the brightness change value of the second unit pixel and summing the weighted brightness value and brightness change value. In another embodiment, the display system 1 can change the brightness value of a second unit pixel to a value between the brightness value and the brightness change value of the second unit pixel.

Next, the display system 1 generates output image data RGB" M×N for the first panel 10 on the basis of the converted input image data RGB' M×N and generates output brightness data BV" m×n for the second panel 20 on the basis of the converted brightness data BV' m×n (S1005).

Specifically, the display system 1 can generate output image data RGB" M×N for the first panel 10 by post-processing the converted input image data RGB' M×N. The display system 1 can convert the converted linear input image data RGB' M×N into the converted nonlinear input image data RGB' M×N. In an embodiment, the display system 1 can convert the linear input image data RGB' M×N into the nonlinear output image data RGB" M×N using a gamma curve function. The display system 1 can gamma-correct the input image data RGB' M×N into the output image data RGB" M×N suitable for the first timing controller 42 using a lookup table.

In addition, the display system 1 can generate the output brightness data BV" m×n for the second panel 20 on the basis of the converted second brightness data BV' m×n. The output brightness data BV" m×n can have a form that can be processed in the second timing controller 43.

According to the present invention, it is possible to prevent occurrence of blurring at an edge of an image by applying an offset to output image data output to the first panel. Accordingly, the present invention can cause an edge of an image displayed on the first panel to be clear and improve perceptual resolution.

In addition, according to the present invention, it is possible to more accurately control a brightness value at an edge of an image for the first panel by calculating a final offset in consideration of a plurality of offsets to cause the edge of the image to be clearer. The present invention can improve the definition of the image.

Furthermore, according to the present invention, it is possible to achieve more effective brightness representation in the second panel by controlling a brightness value of a second unit pixel according to a distribution of a plurality of first unit pixels corresponding to the second unit pixel.

What is claimed is:

1. A display driving device comprising:

a brightness calculator for calculating first brightness data corresponding to a first resolution and second brightness data corresponding to a second resolution less than the first resolution using input image data;

an offset calculator for calculating an offset on the basis of the first brightness data and the second brightness data;

an input image converter for converting the input image data into input image data to which the calculated offset has been applied;

a first data output unit for generating output image data for a first panel using the converted input image data and outputting the generated output image data; and a second data output unit for generating output brightness data for a second panel using the second brightness data and outputting the generated output brightness data, wherein the first panel has the first resolution, includes a plurality of first unit pixels, and each of the plurality of first unit pixels includes a plurality of subpixels having different colors, wherein the second panel has the second resolution and includes a plurality of second unit pixels, and wherein the offset calculator includes a second offset calculator for calculating a second offset on the basis of a brightness value of a first edge unit pixel determined based on a difference in brightness values from adjacent first unit pixels from among the plurality of first unit pixels, an expected brightness value of a second edge unit pixel disposed at a position corresponding to the first edge unit pixel from among the plurality of second unit pixels, and an edge intensity.

2. The display driving device according to claim 1, wherein the first brightness data includes brightness values of the plurality of first unit pixels and the second brightness data includes brightness values of the plurality of second unit pixels.

3. The display driving device according to claim 1, wherein a single second unit pixel corresponds to a plurality of first unit pixels.

4. The display driving device according to claim 1, wherein the calculates the second offset for each of the plurality of first unit pixels on the basis of a difference between the brightness value of the first edge unit pixel and the expected brightness value of the second edge unit pixel and an edge intensity.

5. The display driving device according to claim 1, wherein the second offset calculator calculates weights for a plurality of first neighboring unit pixels disposed adjacent to the first edge unit pixel, and calculates the expected brightness value of the second edge unit pixel by applying the weights to brightness values of second neighboring unit pixels disposed at positions respectively corresponding to the plurality of first neighboring unit pixels from among the plurality of second unit pixels.

6. The display driving device according to claim 2, wherein the offset calculator further includes a third offset calculator for checking brightness deviations in a plurality of first unit pixels corresponding to a second unit pixel and calculating a third offset for increasing or decreasing brightness values of the plurality of first unit pixels corresponding to the second unit pixel when the number of first unit pixels having negative brightness deviations differs from the number of first unit pixels having positive brightness deviations.

7. The display driving device according to claim 6, wherein the third offset calculated by the third offset calculator has a value less than 0 when the number of first unit pixels having negative brightness deviations is greater than the number of first unit pixels having positive brightness deviations and has a value greater than 0 when the number of first unit pixels having negative brightness deviations is less than the number of first unit pixels having positive brightness deviations.

8. The display driving device according to claim 6, wherein the third offset calculator calculates a brightness change value for the corresponding second unit pixel when the number of first unit pixels having negative brightness deviations differs from the number of first unit pixels having positive brightness deviations and calculates a third offset on the basis of a difference between the brightness value of the corresponding second unit pixel and the brightness change value.

9. The display driving device according to claim 8, further comprising a brightness converter for converting the second brightness data into second brightness data to which the brightness change value has been applied, wherein the second data output unit generates the output brightness data for the second panel using the converted second brightness data.

10. The display driving device according to claim 2, wherein the offset calculator further includes:

a first offset calculator for calculating a first offset on the basis of first interpolated brightness data generated by performing interpolation based on the second brightness data and second interpolated brightness data generated by performing interpolation based on the first brightness data and the second brightness data;

a third offset calculator for checking brightness deviations in a plurality of first unit pixels corresponding to a second unit pixel and calculating a third offset for increasing or decreasing brightness values of the plurality of first unit pixels corresponding to the second unit pixel when the number of first unit pixels having negative brightness deviations differs from the number of first unit pixels having positive brightness deviations; and a fourth offset calculator for calculating a fourth offset on the basis of the first offset, the second offset, and the third offset.

11. The display driving device according to claim 10, wherein the fourth offset calculator calculates the fourth offset by multiplying a sum of the first offset, the second offset, and the third offset by a weight depending on a brightness value.

12. The display driving device according to claim 1, further comprising an interpolator for generating first interpolated brightness data corresponding to the first resolution by performing interpolation based on the second brightness data, wherein the offset calculator calculates an offset on the basis of the first brightness data, the second brightness data, and the first interpolated brightness data.

13. The display driving device according to claim 12, wherein the offset calculator further includes a first offset calculator for generating second interpolated brightness data corresponding to the first resolution by performing interpolation based on the first brightness data and the second brightness data and calculating a first offset for each of the plurality of first unit pixels on the basis of a difference between the first interpolated brightness data and the second interpolated brightness data and a difference between the first interpolated brightness data and the first brightness data.

14. The display driving device according to claim 13, wherein the first offset calculator generates the second interpolated brightness data by performing joint bilateral filtering on the first brightness data and the second brightness data.

15. A display driving method comprising:

calculating first brightness data corresponding to a first resolution and second brightness data corresponding to a second resolution less than the first resolution using input image data;

calculating an offset on the basis of the first brightness data and the second brightness data;

converting the input image data into input image data to which the calculated offset has been applied; and generating output image data for a first panel using the converted input image data and generating output brightness data for a second panel using the second brightness data, wherein the first panel has the first resolution, includes a plurality of first unit pixels, and each of the plurality of first unit pixels includes a plurality of subpixels having different colors, wherein the second panel has the second resolution and includes a plurality of second unit pixels, and wherein the calculating of the offset includes calculating a second offset on the basis of a brightness value of a first edge unit pixel determined based on a difference in brightness values from adjacent first unit pixels from among the plurality of first unit pixels, an expected brightness value of a second edge unit pixel disposed at a position corresponding to the first edge unit pixel from among the plurality of second unit pixels, and an edge intensity.

16. The display driving method according to claim 15, wherein a single second unit pixel corresponds to at least two first unit pixels.

17. The display driving method according to claim 16, wherein the calculating of the offset further comprises:

calculating a first offset, and a third offset; and calculating a fourth offset by multiplying a sum of the first offset, the second offset, and the third offset by a weight depending on a brightness value.

18. The display driving method according to claim 17, wherein the calculating of the first offset, and the third offset comprises:

calculating the first offset on the basis of first interpolated brightness data generated by performing interpolation based on the second brightness data and second interpolated brightness data generated by performing interpolation based on the first brightness data and the second brightness data; and checking brightness deviations in a plurality of first unit pixels corresponding to a second unit pixel, calculating a brightness change value of the second unit pixel when the number of first unit pixels having negative brightness deviations differs from the number of first unit pixels having positive brightness deviations, and calculating the third offset on the basis of a brightness value and the brightness change value of the second unit pixel.

19. The display driving method according to claim 18, further comprising converting the second brightness data into second brightness data to which the brightness change value has been applied, wherein the generating of the output brightness data comprises generating output brightness data for the second panel on the basis of the converted second brightness data.

* * * * *